US006470626B2

(12) United States Patent
Luetzow et al.

(10) Patent No.: US 6,470,626 B2
(45) Date of Patent: Oct. 29, 2002

(54) GATE RELEASE MECHANISM WITH DETENT AND PLUNGER, AND GATE INCORPORATING SAME

(75) Inventors: Edwin J. Luetzow; Richard L. Luetzow, both of Brookings, SD (US)

(73) Assignee: MTR, Inc., Brooking, SD (US)

( * ) Notice: Subject to any disclaimer, the term of this patent is extended or adjusted under 35 U.S.C. 154(b) by 0 days.

(21) Appl. No.: 09/764,802

(22) Filed: Jan. 17, 2001

(65) Prior Publication Data

US 2002/0134020 A1 Sep. 26, 2002

(51) Int. Cl.[7] ..... E01F 13/08
(52) U.S. Cl. ..... 49/9; 49/49; 404/10
(58) Field of Search ..... 49/49, 9; 105/341; 404/10

(56) References Cited

U.S. PATENT DOCUMENTS 1,356,302 A * 10/1920 Mills ..... 49/141
1,382,534 A * 6/1921 Oelenschlager ..... 49/247
1,535,753 A * 4/1925 Weiser ..... 246/128
1,665,157 A * 4/1928 Dahnke ..... 49/247
2,098,284 A * 11/1937 Fraser ..... 49/247
2,137,193 A * 11/1938 Stafford ..... 49/247
2,352,310 A * 6/1944 Brown et al. ..... 49/26
3,024,550 A * 3/1962 Kudera et al. ..... 49/247
4,227,344 A * 10/1980 Poppke ..... 49/9
4,364,200 A * 12/1982 Cobb ..... 49/192
4,897,960 A * 2/1990 Barvinek et al. ..... 49/49
5,442,878 A * 8/1995 Flores ..... 49/208
5,469,660 A * 11/1995 Tamenne ..... 49/192
5,653,058 A * 8/1997 Zaimins ..... 49/208

* cited by examiner

*Primary Examiner*—Gregory J. Strimbu
(74) *Attorney, Agent, or Firm*—Hugh D. Jaeger

(57) ABSTRACT

A railroad gate release mechanism which attaches between the mount arms of a railroad gate actuator and a crossing arm to prevent breakage of the crossing arm due to impingement by a vehicle. The railroad gate release mechanism includes a pivotable arm assembly which allows movement of the crossing arm in two directions in response to the impingement and returns the crossing arm to the original and detented position subsequent to the impingement to maintain grade crossing protection. Spring assemblies, a shock absorber and a spring centering assembly act to return the pivotable arm assembly and attached crossing arm to the normal detented position.

8 Claims, 9 Drawing Sheets

GATE RELEASE MECHANISM WITH DETENT AND PLUNGER, AND GATE INCORPORATING SAME

CROSS REFERENCES TO CO-PENDING APPLICATIONS

None.

BACKGROUND OF THE INVENTION

1. Field of the Invention

The present invention is for a railroad gate release mechanism, and in particular, is for a railroad gate release mechanism which allows for maintaining of structural integrity of a railroad grade crossing arm during and subsequent to being struck by an automotive vehicle. Although a railroad gate release mechanism is described, the release mechanism can be incorporated for other uses such as, but not limited to, parking lot gates, restricted access gates, road closure gates, toll gates, and the like.

2. Description of the Prior Art

Railroad crossing grades are protected by railroad grade crossing arms which are stored substantially in a vertical position and which are actuated by railroad gate actuators which reorient the crossing arms to a horizontal position across a railroad grade crossing to warn operators of vehicles of oncoming train traffic and to physically place a barrier in the form of a crossing arm at both sides of the railroad grade crossing to prevent passage of a vehicle into the railroad grade crossing. Motorists unaware of the movement of a crossing arm may impinge the crossing arm to the extent that physical damage occurs where the crossing arm is broken and parted from the railroad gate actuator. Such an occurrence can compromise the safety of the railroad grade crossing in that other motorists will not be warned of impending danger due to the destruction of the crossing arm. Such occurrences compromise safety, as well as add a financial maintenance burden.

SUMMARY OF THE INVENTION

The general purpose of the present invention is to provide a railroad gate release mechanism.

According to one embodiment of the present invention, there is provided a railroad gate release mechanism for attachment between a railroad gate actuator and a crossing arm including opposing channel-shaped brackets which attach to a railroad gate actuator and which also serve as mounting structure for other components of the railroad gate release mechanism. A pivotable arm assembly, to which a crossing arm is attached, pivotally mounts between bearing plates located on the inwardly facing surfaces of the opposing channel-shaped brackets. The pivotable arm assembly is influenced by a detent and plunger arrangement which maintains a perpendicular relationship of the pivotable arm assembly and the attached crossing arm with respect to the railroad gate actuator until acted upon by outside forces, such as a vehicle impinging the crossing arm. Such impingement causes the railroad gate release mechanism, with the attached crossing arm, to pivotally overcome the influence of the detent and plunger arrangement and to swing substantially horizontally out of the way of the impinging vehicle without functional damage to the crossing arm. Such pivotal breaking away substantially reduces the possibility of breakage of the crossing arm, as little bending moment is actually applied to the crossing arm itself due to the substantially unrestricted movement allowed by the railroad gate release mechanism. Subsequent to such impingement and when the vehicle has ceased to contact the crossing arm, spring assemblies function to return the pivotable arm assembly of the railroad gate release mechanism, with the attached crossing arm, to the detented position to continue to offer gated protection at the crossing grade. A shock absorber allows for rapid rate pivoting of the pivotable arm assembly in one direction during impingement and allows for a slower rate return of the pivotable arm assembly in the return direction subsequent to impingement. A centering spring assists in returning of the pivotable arm assembly to the detented position.

One significant aspect and feature of the present invention is a railroad gate release mechanism which secures between the mount arms of a railroad gate actuator and a crossing arm.

Another significant aspect and feature of the present invention is a railroad gate release mechanism which when impinged releasably allows breakaway pivoting in two directions of a crossing arm from a normal and detented position to prevent damage to the crossing arm.

Another significant aspect and feature of the present invention is a railroad gate release mechanism which allows return pivoting of a crossing arm to a normal and detented position subsequent to breakaway pivoting caused by impingement.

Still another significant aspect and feature of the present invention is a railroad gate release mechanism which offers grade crossing protection subsequent to crossing arm impingement.

Yet another significant aspect and feature of the present invention is the use of cables attached to a pivotable arm assembly which connect to springs in spring assemblies which are compressed during impingement with the front side of a crossing arm to subsequently power the return of the pivotable arm assembly and attached crossing arm to an original and detented position.

A further significant aspect and feature of the present invention is the use of a shock absorber which allows rapid deployment and release of a pivotable arm assembly and attached crossing arm during impingement and which allows return of the pivotable arm assembly and attached crossing arm at a slower rate subsequent to impingement, whereby the slower return rate reduces return overshoot of the pivotable arm assembly and the crossing arm.

A still further significant aspect and feature of the present invention is the use of a centering spring assembly which urges the pivotable arm assembly into a normal and detented position when the crossing arm is impinged from the rear side.

Having thus described an embodiment of the present invention and set forth significant aspects and features thereof, it is the principal object of the present invention to provide a railroad gate release mechanism.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
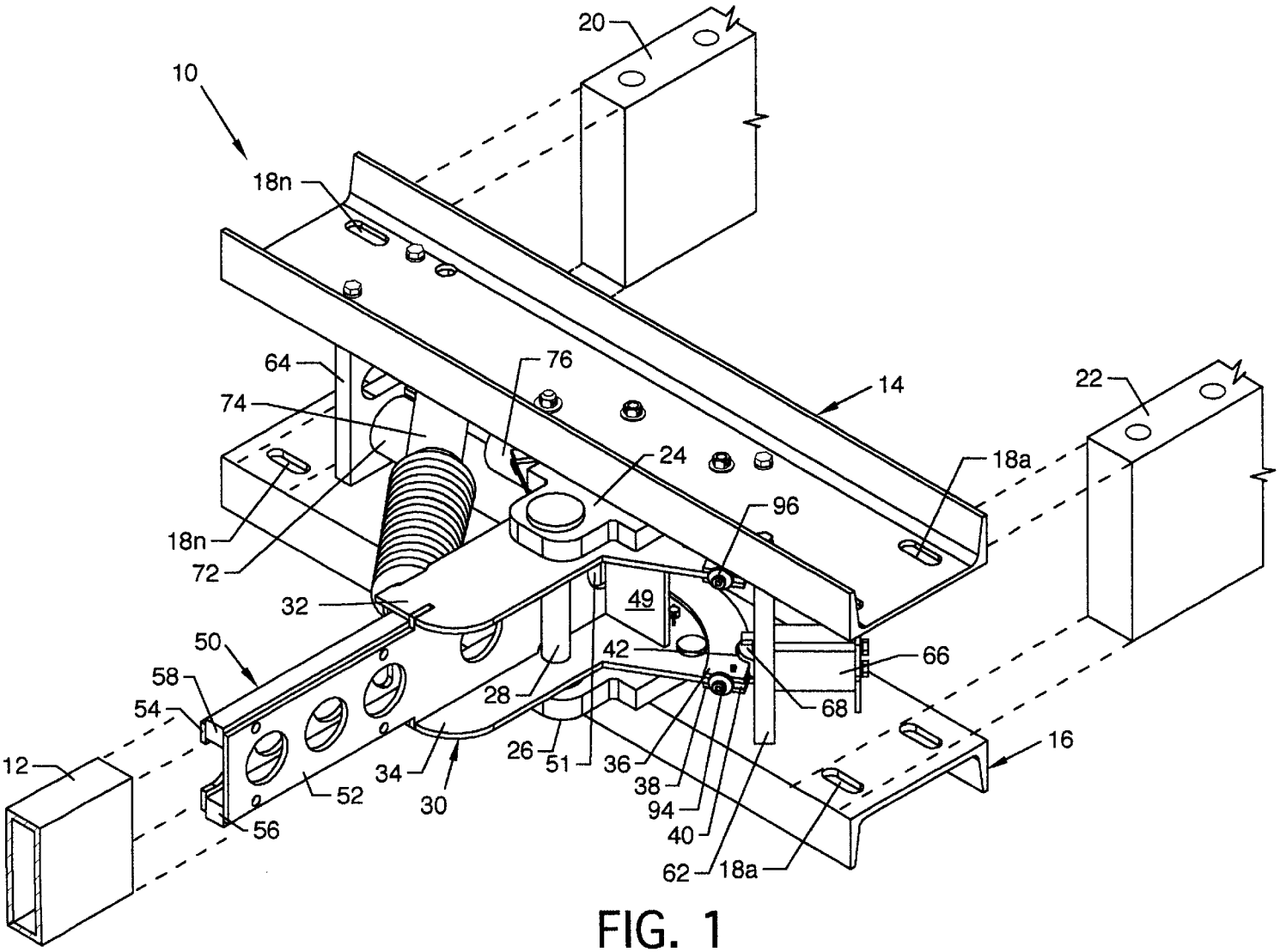
FIG. 1 illustrates an isometric view of a railroad gate release mechanism, the present invention, along with portions of mount arms and a crossing arm which are associated therewith in use.
Figure 1A:
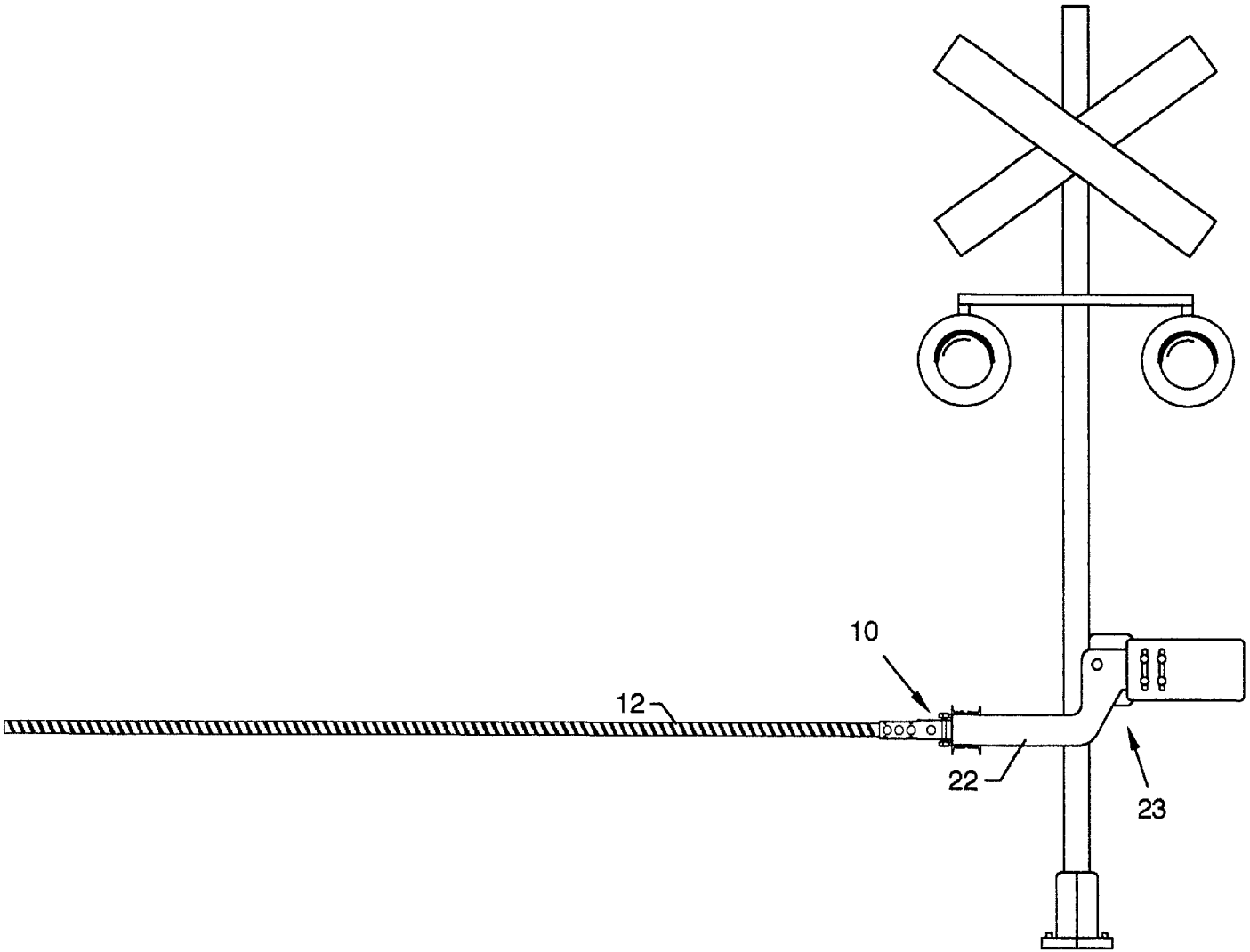
FIG. 1*a* illustrates the use of the railroad gate release mechanism of the present invention in combination with a prior art actuator.

FIG. 1 illustrates an isometric view of the railroad gate release mechanism 10, the present invention, shown in the position which it has between mount arms 20 and 22 of a railroad gate actuator 23 (FIG. 1*a*) and a crossing arm 12 when the crossing arm 12 is in the horizontal position, such as for stopping of traffic at a railroad grade crossing.

Figure 2:
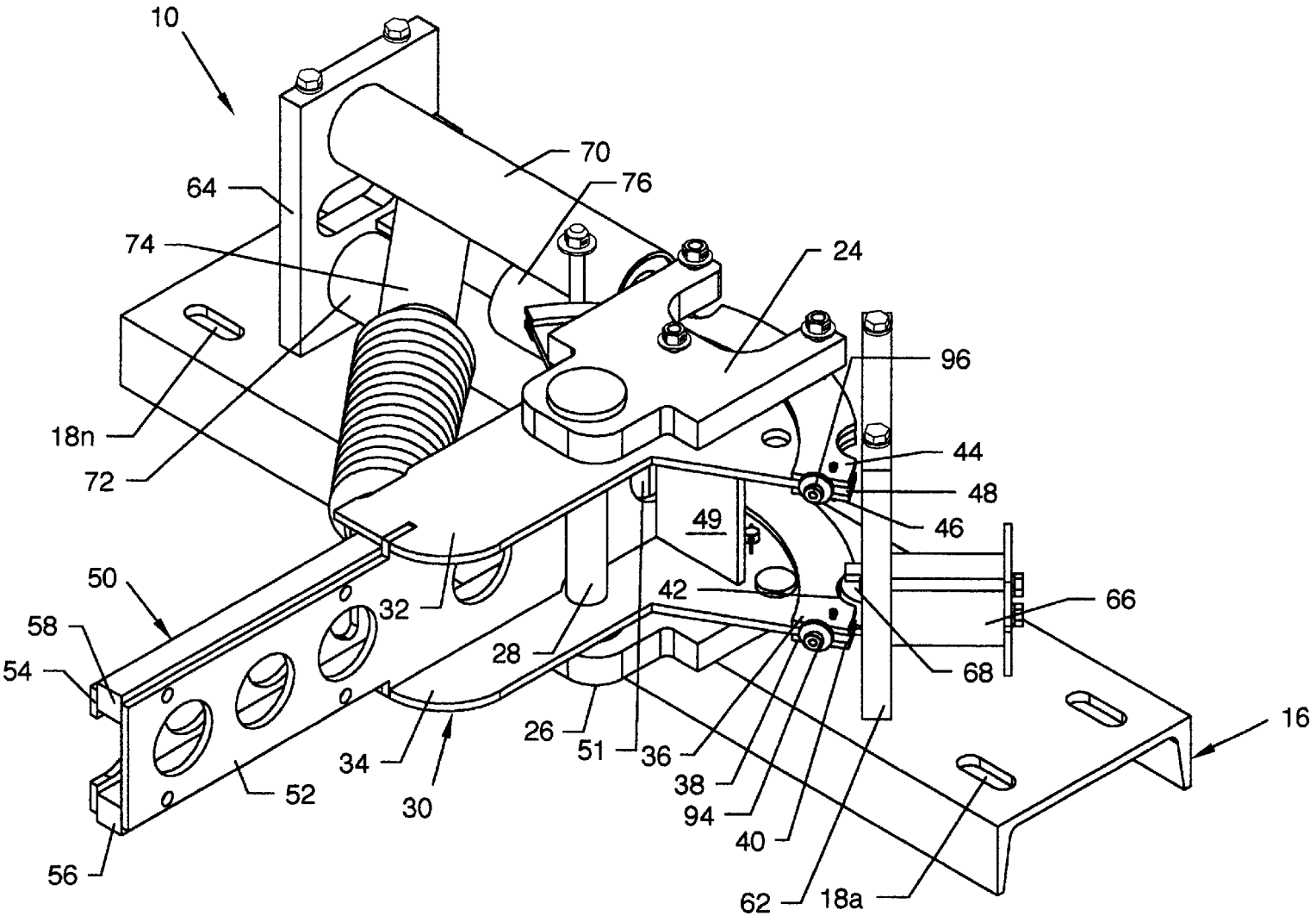
FIG. 2 illustrates the railroad gate release mechanism with an upper bracket removed.

FIG. 2 illustrates the railroad gate release mechanism 10 with an upper bracket 14 removed for the purpose of clarity. With respect to FIGS. 1 and 2, the invention is further described. Partial or fully visible components of the railroad gate release mechanism 10 include opposing upper and lower brackets 14 and 16 each having a plurality of mounting holes 18*a*–18*n* for attachment to the mount arms 20 and 22 of a railroad gate actuator 23, as well as other holes for mounting of other components thereto. Opposing upper and lower bearing plates 24 and 26 suitably secure to the inwardly facing surfaces of the upper and lower brackets 14 and 16 to accommodate a vertically oriented pivot pin 28 and a pivotable arm assembly 30. The pivotable arm assembly 30 aligns between the upper and lower brackets 14 and 16 and is pivotally secured therebetween by the pivot pin 28. The pivotable arm assembly 30 includes, in part, an arm 50 and opposing geometrically configured and horizontally aligned upper and a lower swing plates 32 and 34. Arm 50 serves as a mount for the crossing arm 12, shown in FIG. 1. One end of the lower swing plate 34 is in the shape of an arc to which opposing cable guide plates 36 and 38 are opposingly and suitably secured. The cable guide plates 36 and 38 extend beyond the arced end of the lower swing plate 34 to form a cable channel 40 therebetween. A semi-circular detent 42 is comprised of semi-circular cutouts in each of the cable guide plates 36 and 38 the combination of which forms detent 42. The upper swing plate 32 is fashioned similarly to the lower swing plate 34 and includes opposing cable guide plates 44 and 46 to form a cable channel 48. Brace plates 49 and 51 (FIG. 4) also align between the upper swing plate 32 and the lower swing plate 34 and abut opposing sides of a right arm plate 52. The arm 50 aligns and suitably secures between the upper swing plate 32 and the lower swing plate 34. The arm 50 includes the right arm plate 52 aligned between the full length of the upper swing plate 32 and the lower swing plate 34. The right arm plate 52 extends outwardly beyond the upper swing plate 32 and the lower swing plate 34 and, as such, serves as a mount for a left arm plate 54 and spacer bars 56 and 58 disposed therebetween. A portion of the right arm plate 52 extends along the length of the upper swing plate 32 and the lower swing plate 34. A right brace plate 62 and a left brace plate 64 are mounted vertically between the upper bracket 14 and the lower bracket 16. A plunger housing 66 including a spring loaded movable plunger 68 mounts to the right brace plate 62. The plunger 68 engages the detent 42 of the pivotable arm assembly 30 to maintain the position of the pivotable arm assembly 30 where the crossing arm 12 is extended across a grade crossing. The left brace plate 64 also serves as a mounting plate for upper and lower spring assemblies 70 and 72, a shock absorber 74, and a centering spring assembly 76.

Figure 3:
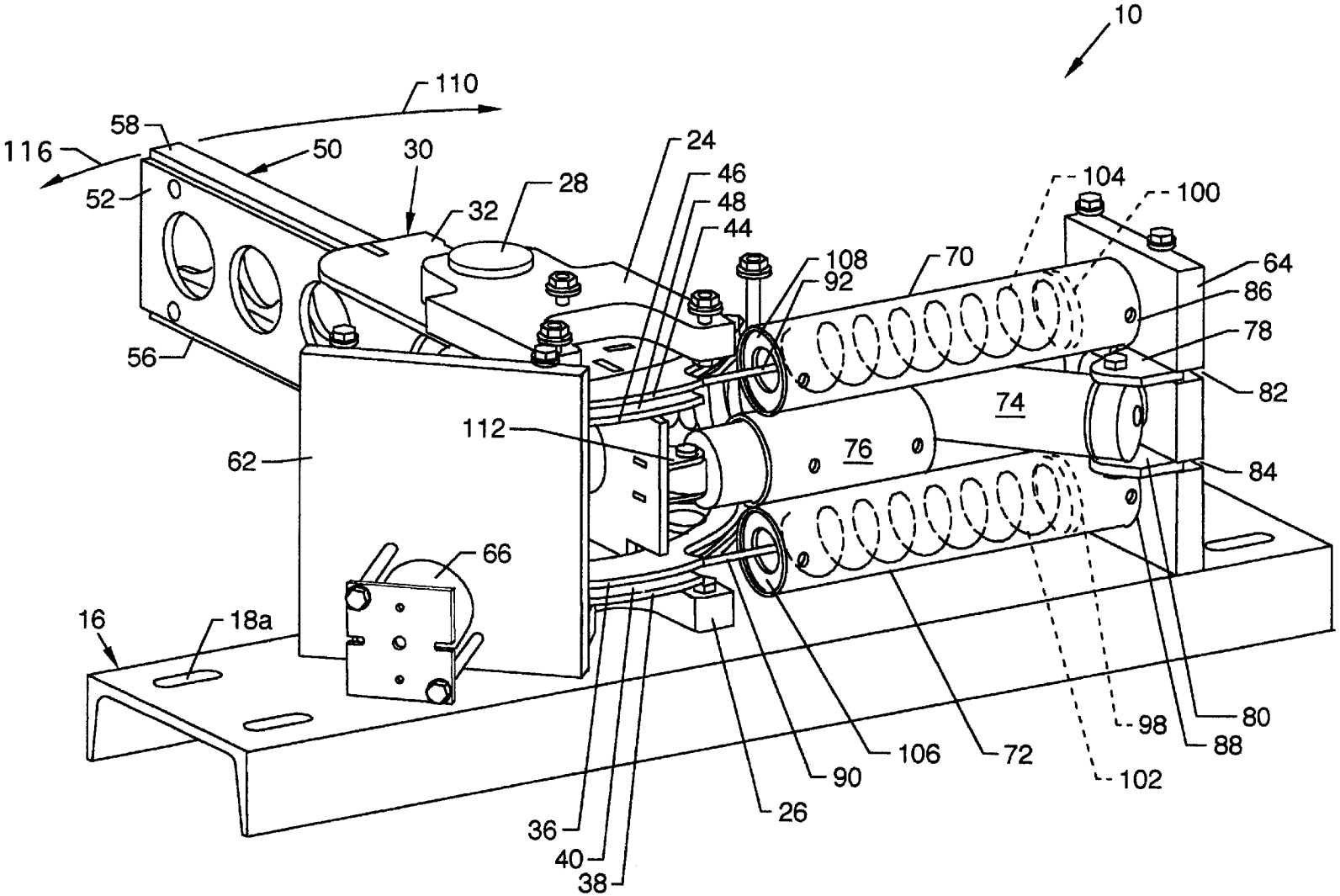
FIG. 3 illustrates a rear isometric view of the elements of FIG. 2.

FIG. 3 illustrates a rear isometric view of the elements of FIG. 2. Illustrated in particular is the relationship of the pivotable arm assembly 30 to the upper and lower spring assemblies 70 and 72, the centering spring assembly 76, and the shock absorber 74. opposing mounting brackets 78 and 80 align and suitably secure into slots 82 and 84, respectively, in the left brace plate 64. One end of the shock absorber 74 pivotally secures to the mounting brackets 78 and 80, and the other end of the shock absorber 74 pivotally secures to a pair of mounting brackets on the arm 50. The shock absorber 74 when moved to the compressed position allows rapid movement of the pivotable arm assembly 30 and allows a slower rate of movement when returning to the extended position to suitably control the return rate of the pivotable arm assembly 30 subsequent to impingement of the crossing arm 12. The horizontally oriented upper and lower spring assemblies 70 and 72 align and suitably secure in bores 86 and 88 in the left brace plate 64. One end of cables 90 and 92 secure by ball ends 94 and 96 (FIG. 2) and align in the cable channels 40 and 48 of the lower and upper swing plates 34 and 32, respectively. The other ends of the cables 90 and 92 secure to circular plates 98 and 100 located inside of the lower and upper spring assemblies 72 and 70. Springs 102 and 104 are located interior to the lower and upper spring assemblies 72 and 70 between the circular plates 98 and 100 and the inward facing ends 106 and 108 of the lower and upper spring assemblies 72 and 70. Movement of the pivotable arm assembly 30 including its arm 50 in a direction as indicated by arrow 110 causes compression of the springs 102 and 104 to provide for subsequent spring powered action of the pivotable arm assembly 30 to return the pivotable arm assembly 30 to its normal detented position subsequent to impingement of the crossing arm 12.

Figure 4:
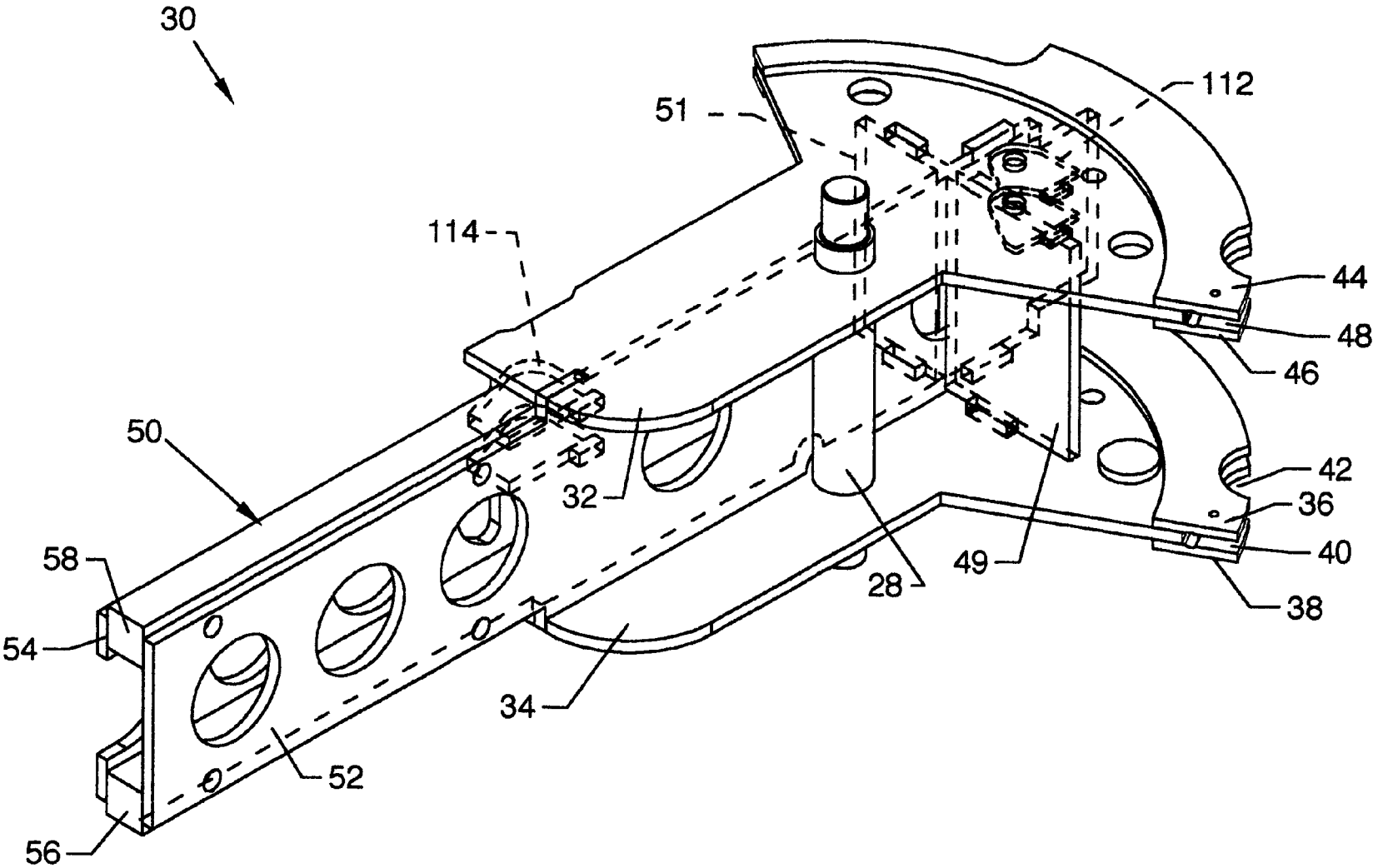
FIG. 4 illustrates an isometric view of the pivotable arm assembly.

FIG. 4 illustrates an isometric view of the pivotable arm assembly 30. Illustrated in particular are the tabbed brace plates 49 and 51 extending vertically and secured between the upper swing plate 32 and the lower swing plate 34. One set of mounting brackets 112 secures at one end of the right arm plate 52 to serve as a mount for one end of the centering spring assembly 76 (FIG. 3), and another set of mounting brackets 114 secures at a mid-position on the left arm plate 54 to serve as a mount for one end of the shock absorber 74 of FIG. 1.

Figure 5:
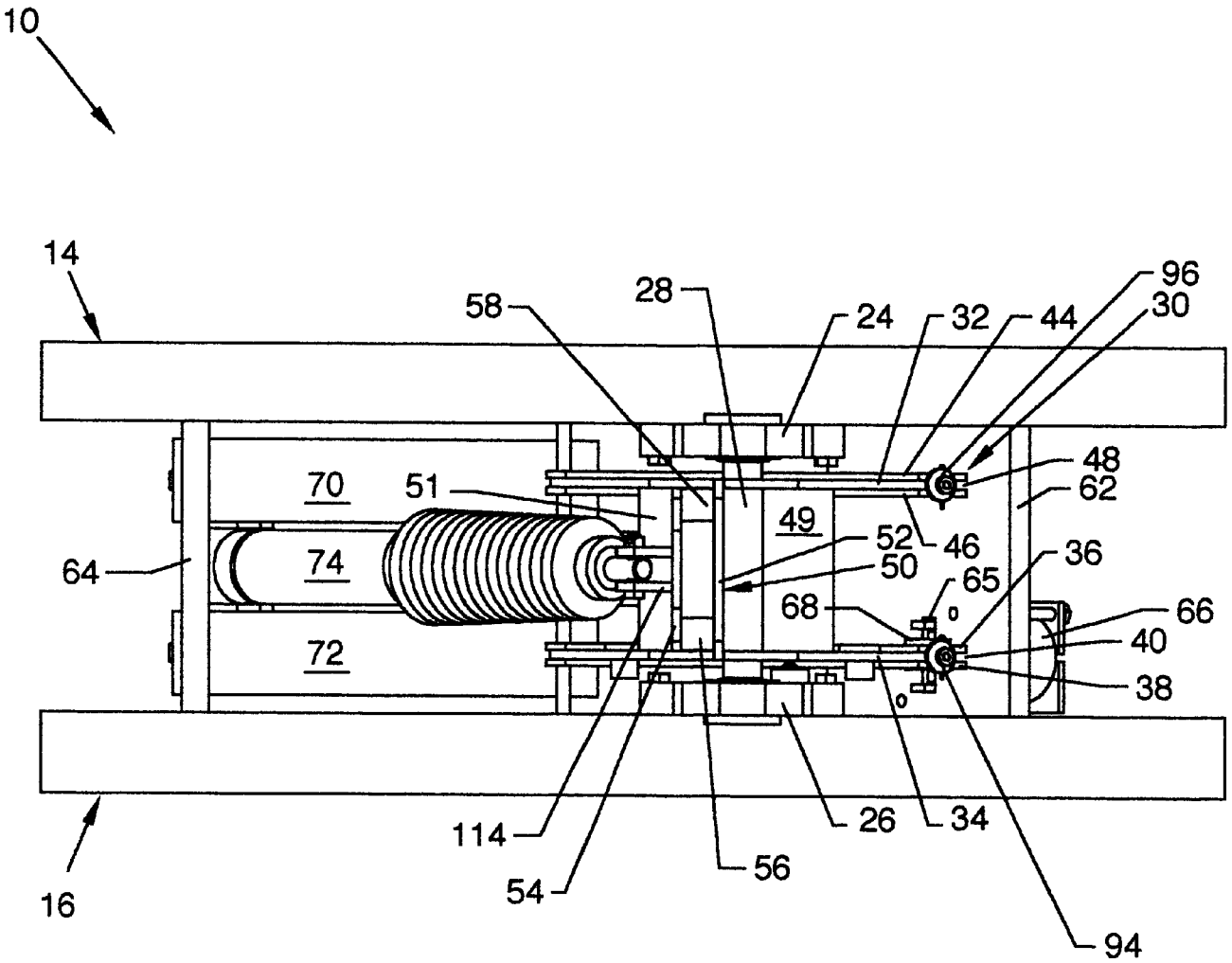
FIG. 5 illustrates an end view of the railroad gate release mechanism.

FIG. 5 illustrates an end view of the railroad gate release mechanism 10. A rectangular hole 65 is provided in the right mounting plate 62 to accommodate the plunger 68 and to accommodate other mounting geometry of the plunger housing 66.

Figure 6:
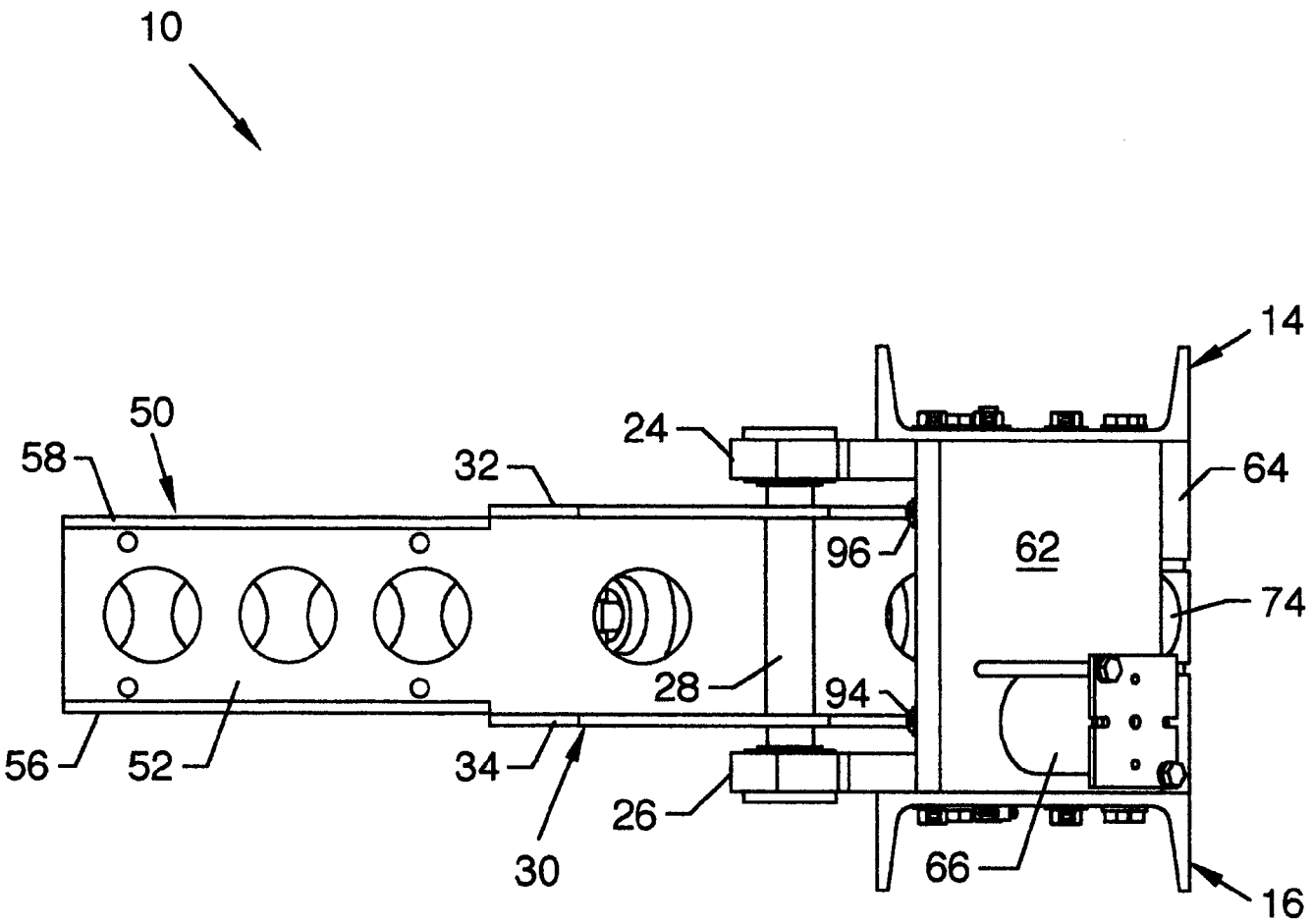
FIG. 6 illustrates a side view of the railroad gate release mechanism.

FIG. 6 illustrates a side view of the railroad gate release mechanism 10, where all numerals correspond to those elements previously described.

Figure 7:
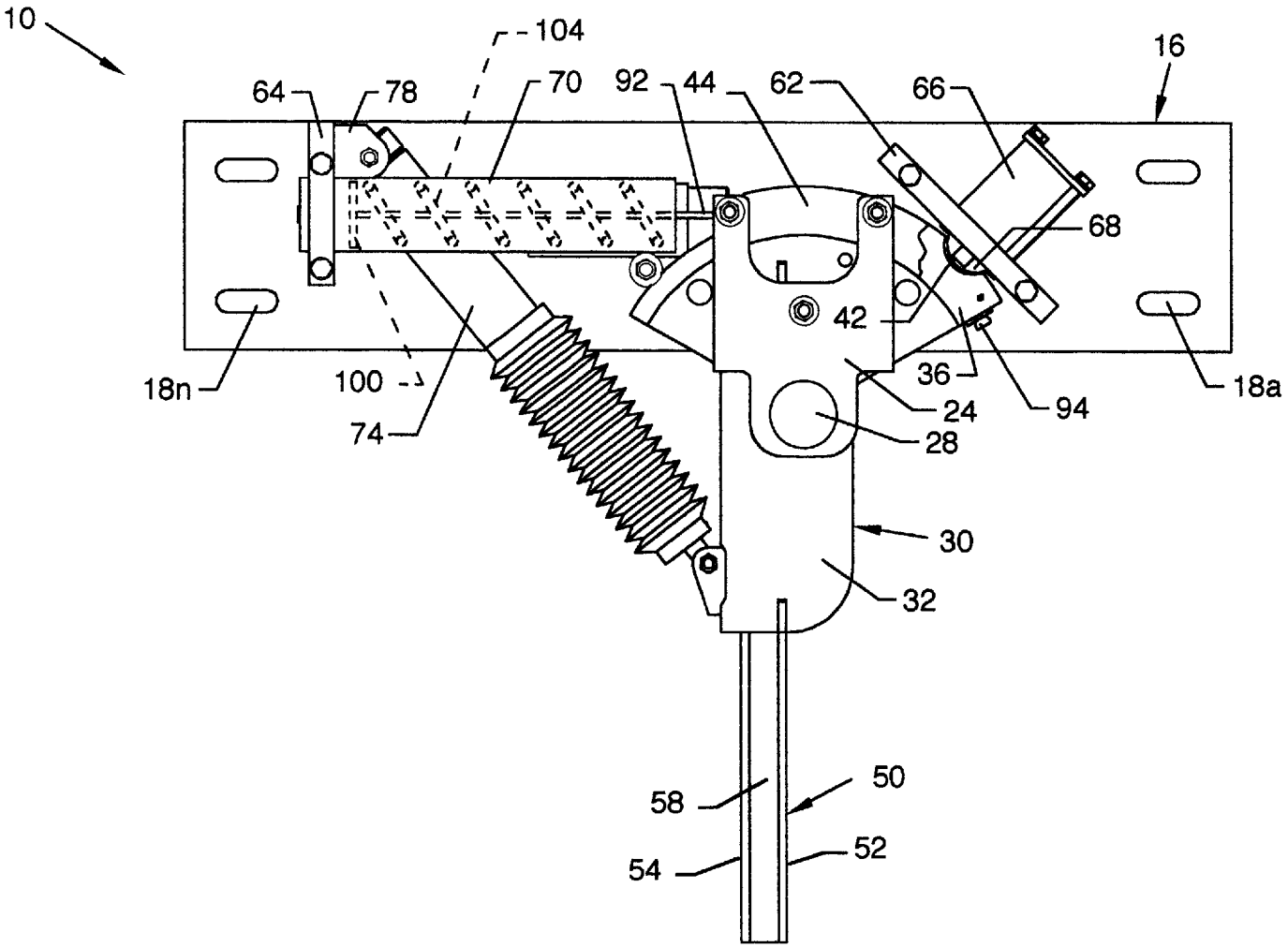
FIG. 7 illustrates a top view of the railroad gate release mechanism in partial cutaway showing its normal position when in use; and, FIG. 8 illustrates a top view of the railroad gate release mechanism in partial cutaway showing how it moves when the crossing arm is impinged by a vehicle or other object.

FIG. 7 illustrates a top view of the railroad gate release mechanism 10 in partial cutaway showing its normal position when in use, where all numerals correspond to those elements previously described. The cable guide plate 44 and underlying cable guide plate 46 are shown in partial cutaway to reveal the detent 42 in the lower swing plate 34 of the pivotable arm assembly 30. The spring loaded plunger 68 engages the detent 42 of the pivotable arm assembly 30 to maintain the position of the pivotable arm assembly 30 where the crossing arm 12 (FIG. 1) is extended across a grade crossing. The spring loaded plunger 68 is of sufficient strength to maintain the pivotable arm assembly 30 including its arm 50 and an attached crossing arm 12 in the desired orientation during raising and lowering and to maintain the desired orientation extending across the crossing grade unless impinged by a vehicle.

Figure 8:
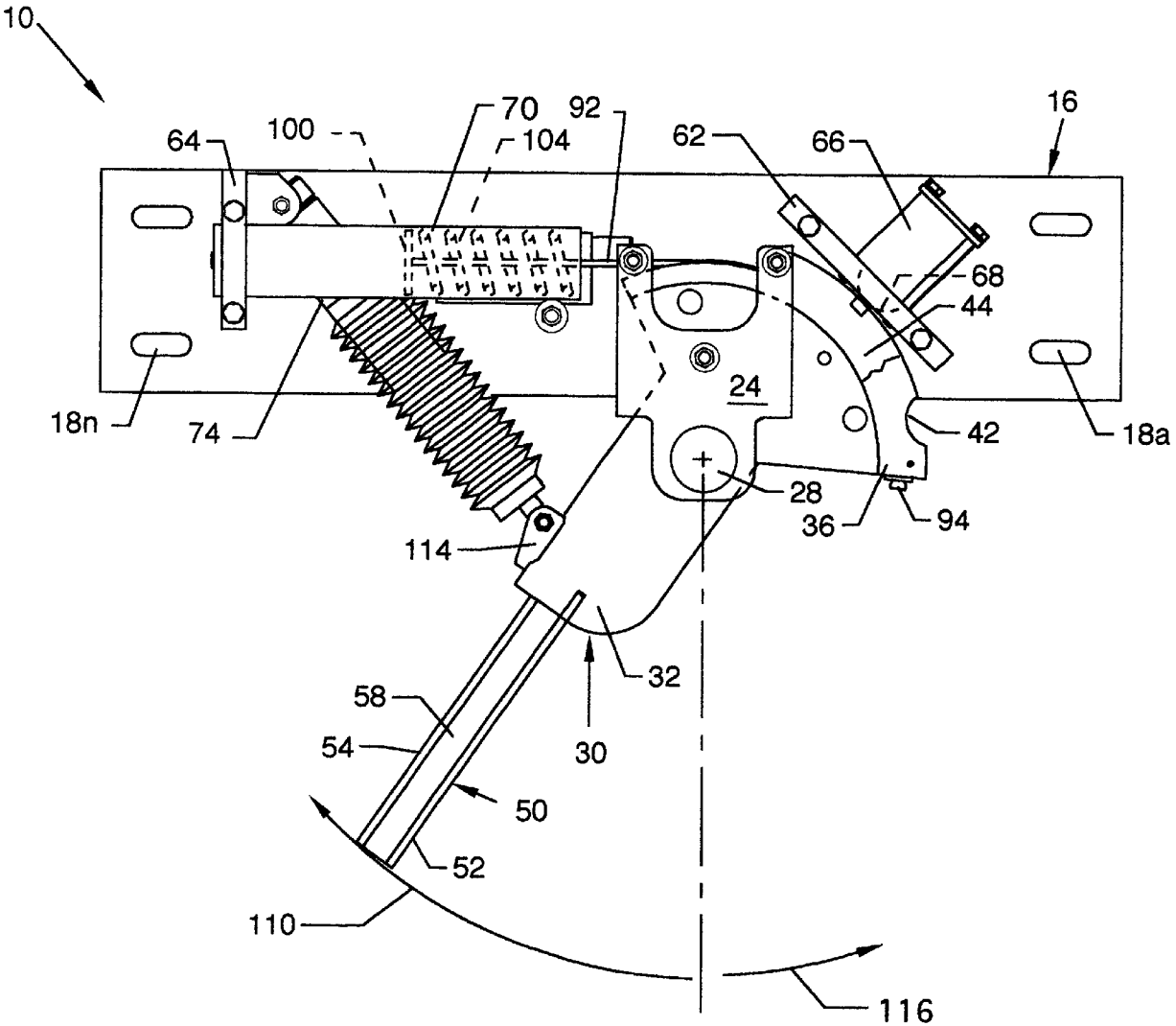

FIG. 8 illustrates a top view of the railroad gate release mechanism 10 in partial cutaway and best illustrates the mode of operation of the railroad gate release mechanism 10, where all numerals correspond to those elements previously described. Pivotal arm relief is provided for front side or rear side impingement of the attached crossing arm 12. Impingement of the front side of the attached crossing arm 12 by a vehicle or other object forces pivoting of the pivotable arm assembly 30 about the pivot pin 28, as shown by arrow 110. Such pivoting allows, for purposes of example and illustration, rotation of 40° of the pivoting arm assembly 30 about the pivot pin 28. Such forced pivoting causes disengagement of the spring loaded plunger 68 from the detent 42 of the pivotable arm assembly 30, thus allowing the pivotable arm assembly 30 and attached crossing arm 12 to pivot, thereby preserving the integrity of the attached crossing arm 12. Pivoting of the pivotable arm assembly 30 and attached crossing arm 12 is allowed at a suitable and rapid rate and is not greatly influenced by the shock absorber 74. However, return of the pivotable arm assembly 30 and attached crossing arm 12 to the detented position is influenced by the shock absorber 74 which acts to allow return pivoting at a rate much less than that during impingement-caused pivoting. During impingement-caused pivoting of the pivotable arm assembly 30 and attached crossing arm 12, spring 104 in the upper spring assembly 70 and spring 102 in the lower spring assembly 72 are compressed by the movement of the cables 92 and 90, respectively, which are attached in the cable channels 48 and 40 located on the ends of the upper swing plate 32 and the lower swing plate 34, respectively. Such spring compression provides force to return the pivotable arm assembly 30 and attached crossing arm 12 towards and into the detented position at a controlled rate as provided by the shock absorber 74, as previously described.

Impingement of the rear side of the attached crossing arm 12 provides for disengagement of the spring loaded plunger 68 from the detent 42 of the pivotable arm assembly 30, thus allowing the pivotable arm assembly 30 and attached crossing arm 12 to pivot, thereby preserving the integrity of the crossing arm 12. Such pivoting allows, for purposes of example and illustration, rotation of 15° of the pivoting arm assembly 30 about the pivot pin 28 as generally shown by arrow 116. The centering spring assembly 76 urges and assists the pivotable arm assembly 30 to return to a normal and detented position.

Various modifications can be made to the present invention without departing from the apparent scope hereof.

It is claimed:

1. For use with a gate having a horizontally extending barrier arm and an actuator for raising the barrier arm to allow passage through the gate, a release mechanism for attachment between the barrier arm and the actuator and operable when the barrier arm is impacted to allow the barrier arm to swing horizontally and thereby withstand the impact without breaking, the release mechanism comprising:

a. opposing, spaced apart brackets for attachment to the actuator;

b. a pivotable arm assembly pivoted to said brackets, said pivotable arm assembly comprising a swing plate having a rearward end and a forward end and an elongated arm having a rearward end and a forward end, said forward end of said swing plate being attached to said rearward end of said elongated arm and said rearward end of said swing plate protruding rearwardly beyond said rearward end of said elongated arm, said forward end of said elongated arm extending forwardly beyond said forward end of said swing plate and having a portion to which the barrier arm is attachable; and, c. a detent provided in said rearward end of said swing plate and a spring-loaded plunger engaging said detent to hold said pivotable arm assembly perpendicular with respect to said brackets, said plunger being releasable from said detent upon an impacting force being exerted on said elongated arm to allow said pivotable arm assembly to pivot from said perpendicular relationship with respect to said brackets.

2. The release mechanism as defined in claim 1, further comprising means for returning said pivotable arm assembly to said perpendicular relationship with respect to said brackets with said plunger engaging said detent when said impacting force is no longer applied.

3. The release mechanism as defined in claim 2, wherein said means for returning said pivotable arm assembly to said perpendicular relationship with respect to said brackets includes a spring assembly.

4. The release mechanism as defined in claim 3, wherein said swing plate has an arcuate edge at said rearward end thereof, and wherein said spring assembly includes a spring and a cable which is connected with said spring, said cable extending from said spring along said arcuate edge of said swing plate to an end thereof anchored to said swing plate.

5. The release mechanism as defined in claim 3, wherein said means for returning said pivotable arm assembly to said perpendicular relationship with respect to said brackets further includes a shock absorber.

6. The release mechanism as defined in claim 1, further including a second swing plate identical to said first-mentioned swing plate, said second swing plate being attached to said elongated arm and lying parallel to and in alignment with said first-mentioned swing plate.

7. A gate comprising:

a. a horizontally extending barrier arm;

b. an actuator for raising said horizontally extending barrier arm; and, c. a release mechanism located between and coupled to said barrier arm and said actuator and operable when said barrier arm is impacted to allow said barrier arm to swing horizontally and thereby withstand the impact without breaking, said release mechanism comprising:

(1) opposing, spaced apart brackets attached to said actuator;

(2) a pivotable arm assembly pivoted to said brackets, said pivotable arm assembly comprising a swing plate having a rearward end and a forward end and an elongated arm having a rearward end and a forward end, said forward end of said swing plate being attached to said rearward end of said elongated arm and said rearward end of said swing plate protruding rearwardly beyond said rearward end of said elongated arm, said forward end of said elongated arm extending forwardly beyond said forward end of said swing plate and having a portion attached to said barrier arm; and, (3) a detent provided in said rearward end of said swing plate and a spring-loaded plunger engaging said detent to hold said pivotable arm assembly and barrier arm perpendicular with respect to said brackets, said plunger being releasable from said detent upon an impacting force being exerted on said barrier arm to allow said pivotable arm assembly and barrier arm to swing horizontally from said perpendicular relationship with respect to said brackets.

8. The gate as defined in claim 7, further comprising means for returning said pivotable arm assembly and barrier arm to said perpendicular relationship with respect to said brackets with said plunger engaging said detent when said impacting force is no longer applied.

* * * * *